US009904212B2

(12) United States Patent
Meneses

(10) Patent No.: US 9,904,212 B2
(45) Date of Patent: Feb. 27, 2018

(54) TONER AGITATION SYSTEM INCLUDING A CAM DRIVEN RECIPROCATING TONER AGITATOR

(71) Applicant: LEXMARK INTERNATIONAL, INC., Lexington, KY (US)

(72) Inventor: Johnny Alota Meneses, Cebu (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/140,573

(22) Filed: Apr. 28, 2016

(65) Prior Publication Data

US 2017/0075257 A1 Mar. 16, 2017

Related U.S. Application Data

(60) Provisional application No. 62/218,610, filed on Sep. 15, 2015.

(51) Int. Cl.

| | |
|---|---|
| ***G03G 21/00*** | (2006.01) |
| ***G03G 15/08*** | (2006.01) |
| ***G03G 21/12*** | (2006.01) |

(52) U.S. Cl.

CPC ..... *G03G 15/0889* (2013.01); *G03G 21/12* (2013.01); *G03G 15/0865* (2013.01)

(58) Field of Classification Search

CPC . G03G 15/0865; G03G 15/0889; G03G 21/12

See application file for complete search history.

(56) References Cited

U.S. PATENT DOCUMENTS

| | | | | |
|---|---|---|---|---|
| 7,280,776 | B2 | 10/2007 | Cook et al. | |
| 8,233,834 | B2 | 7/2012 | Horrall et al. | |
| 2006/0159497 | A1* | 7/2006 | Choi | G03G 21/0011 399/358 |
| 2007/0264036 | A1* | 11/2007 | Craig | G03G 21/105 399/35 |
| 2008/0226367 | A1* | 9/2008 | Kim | G03G 21/12 399/358 |

FOREIGN PATENT DOCUMENTS

| | | | | |
|---|---|---|---|---|
| FR | 2205686 B1 * | 7/1977 | ..... | G03G 15/0865 |
| JP | 54095244 A * | 7/1979 | | |

* cited by examiner

*Primary Examiner* — Francis Gray

(74) *Attorney, Agent, or Firm* — Justin M. Tromp

(57) ABSTRACT

A toner agitation system according to one example embodiment includes a toner agitator movable in a reciprocating manner. A cam follower is operatively connected to the toner agitator. A rotatable cam has a cam surface that contacts the cam follower. A biasing member biases the cam follower into contact with the cam surface. Contact between the cam surface and the cam follower during rotation of the cam causes the toner agitator to move in the reciprocating manner.

18 Claims, 5 Drawing Sheets

TONER AGITATION SYSTEM INCLUDING A CAM DRIVEN RECIPROCATING TONER AGITATOR

CROSS REFERENCES TO RELATED APPLICATIONS

This application claims priority to U.S. Provisional Patent Application Ser. No. 62/218,610, filed Sep. 15, 2015, entitled "Reciprocating Toner Agitator Drive," the content of which is hereby incorporated by reference in its entirety.

BACKGROUND

1. Field of the Disclosure

The present invention relates generally to electrophotographic image forming devices and more particularly to a cam driven reciprocating toner agitator.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) either directly by the photoconductive drum in a one-step transfer system or indirectly by an intermediate transfer member in a two-step transfer system. The toner is then fused to the media using heat and pressure to complete the print. Not all of the toner picked up by the photoconductive drum is transferred to the print media or intermediate transfer member due to inefficiencies in the image transfer process. Residual toner left on the photoconductive drum after the photoconductive drum has contacted the print media or intermediate transfer member is removed before the next image is formed in order to avoid contamination of the next image. For this purpose, a cleaner blade or a cleaner brush in contact with the photoconductive drum (and, in a two-step transfer system, the intermediate transfer member) removes the residual toner from its surface.

The residual toner removed by the cleaner blade or cleaner brush is typically stored in a reservoir of a waste toner container that is replaced periodically when it fills with toner in order to accommodate additional waste toner. Similarly, the image forming device's toner supply is typically stored in reservoirs of one or more units that are replaced periodically in order to continue to provide toner to the image forming device for printing. The reservoirs that store fresh toner and waste toner include agitators that fluff and mix the toner in the reservoir to prevent it from clumping and to distribute the toner more evenly throughout the reservoir.

SUMMARY

A toner agitation system according to one example embodiment includes a toner agitator movable in a reciprocating manner. A cam follower is operatively connected to the toner agitator. A rotatable cam has a cam surface that contacts the cam follower. A biasing member biases the cam follower into contact with the cam surface. Contact between the cam surface and the cam follower during rotation of the cam causes the toner agitator to move in the reciprocating manner.

A toner container according to one example embodiment includes a housing having a reservoir for storing toner. A toner agitator is movable in a reciprocating manner within the reservoir. A cam follower is operatively connected to the toner agitator. A rotatable cam has a cam surface that contacts the cam follower. A biasing member biases the cam follower into contact with the cam surface. Contact between the cam surface and the cam follower during rotation of the cam causes the toner agitator to move in the reciprocating manner.

A container for storing waste toner in an electrophotographic image forming device according to one example embodiment includes a housing having a reservoir for storing toner. At least one toner inlet permits toner to enter the reservoir. A toner agitator is movable in a reciprocating manner within the reservoir. The toner agitator includes a cam follower. A rotatable cam has a cam surface that contacts the cam follower. A biasing member biases the cam follower into constant contact with the cam surface throughout an entire rotational path of the cam. Contact between the cam surface and the cam follower during rotation of the cam causes the toner agitator to move back and forth in the reciprocating manner against a direction of bias of the biasing member on the cam follower and in the direction of bias of the biasing member on the cam follower.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
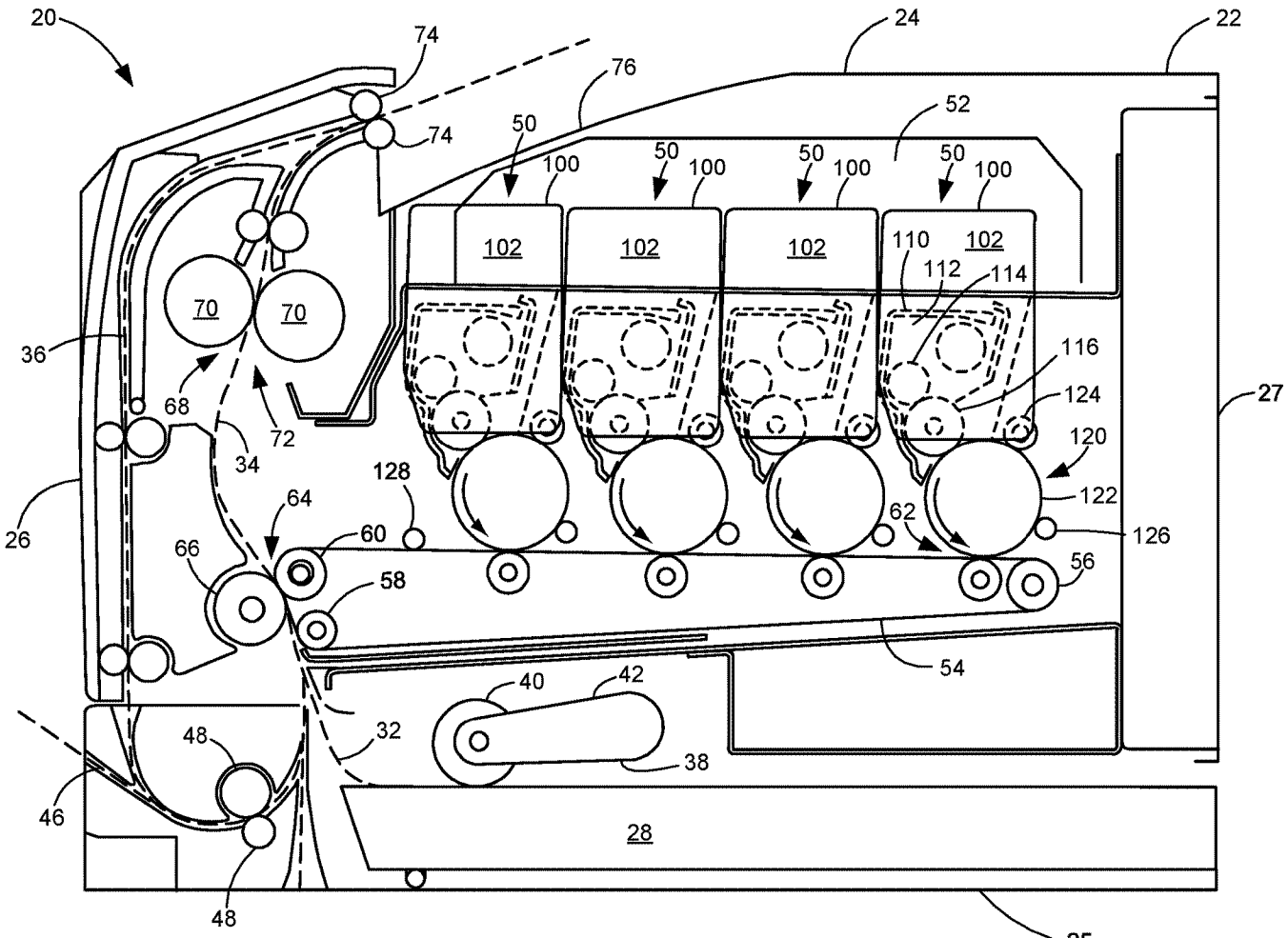
FIG. 1 is a schematic view of an image forming device according to one example embodiment.

FIG. 1 illustrates a schematic view of the interior of an example image forming device 20. Image forming device 20 includes a housing 22 having a top 24, bottom 25, front 26 and rear 27. Housing 22 includes one or more input trays 28 positioned therein. Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel (not shown) may be located on housing 22. Using the control panel, a user is able to enter commands and generally control the operation of the image forming device 20. For example, the user may enter commands to switch modes (e.g., color mode, monochrome mode), view the number of pages printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rolls. Media sheets may also be introduced into media path 32 by a manual feed 46 having one or more rolls 48.

Image forming device 20 includes an image transfer section that includes one or more imaging stations 50. In the example embodiment illustrated, each imaging station 50 includes a toner cartridge 100, a developer unit 110 and a photoconductor unit 120. Each toner cartridge 100 includes a reservoir 102 for holding toner and an outlet port in communication with an inlet port of a corresponding developer unit 110 for periodically transferring toner from reservoir 102 to developer unit 110 in order to replenish the developer unit 110. In the example embodiment illustrated, image forming device 20 utilizes what is commonly referred to as a single component development system. In this embodiment, each developer unit 110 includes a toner reservoir 112 and a toner adder roll 114 that moves toner from reservoir 112 to a developer roll 116. One or more agitating members may be positioned within each of reservoir 102 and reservoir 112 to aid in moving the toner. Each photoconductor unit 120 includes a photoconductive (PC) drum 122, a charge roll 124 and a cleaner blade or roll 126. PC drums 122 are mounted substantially parallel to each other. For purposes of clarity, developer unit 110 and photoconductor unit 120 are labeled on only one of the imaging stations 50. Each imaging station 50 may be substantially the same except for the color of toner used.

Each charge roll 124 forms a nip with the corresponding PC drum 122. During a print operation, charge roll 124 charges the surface of PC drum 122 to a specified voltage, such as, for example, −1000 volts. A laser beam from a printhead 52 associated with each imaging station 50 is then directed to the surface of PC drum 122 and selectively discharges those areas it contacts to form a latent image on the surface of PC drum 122. In one embodiment, areas on PC drum 122 illuminated by the laser beam are discharged to approximately −300 volts. Developer roll 116, which forms a nip with the corresponding PC drum 122, then transfers toner to the latent image on the surface of PC drum 122 to form a toner image. The toner is attracted to the areas of PC drum 122 surface discharged by the laser beam from the printhead 52. A metering device, such as a doctor blade, can be used to meter toner onto developer roll 116 and apply a desired charge on the toner prior to its transfer to PC drum 122.

An intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 122 apply toner images in their respective colors to ITM 54 at a first transfer nip 62. In one embodiment, a positive voltage field attracts the toner image from PC drums 122 to the surface of the moving ITM 54. ITM 54 rotates and collects the one or more toner images from imaging stations 50 and then conveys the toner images to a media sheet at a second transfer nip 64 formed between a transfer roll 66 and ITM 54, which is supported by back-up roll 60. The cleaner roll 126 of each photoconductor unit 120 removes any toner remnants on PC drum 122 so that the surface of PC drum 122 may be charged and developed with toner again.

A media sheet advancing through simplex path 34 receives the toner image from ITM 54 as it moves through the second transfer nip 64. The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, exit rolls 74 move the media sheet from simplex path 34 to an output area 76 on top 24 of image forming device 20. In a reverse direction, exit rolls 74 move the media sheet into duplex path 36 for image formation on a second side of the media sheet. A cleaner roll 128 removes any toner remnants on ITM 54 so that the surface of ITM 54 may receive toner from PC drums 122 again.

While the example image forming device 20 shown in FIG. 1 illustrates four toner cartridges 100 and four corresponding developer units 110 and photoconductor units 120, it will be appreciated that a monocolor image forming device 20 may include a single toner cartridge 100 and corresponding developer unit 110 and photoconductor unit 120 as compared to a multicolor image forming device 20 that may include multiple toner cartridges 100, developer units 110 and photoconductor units 120. Further, although image forming device 20 utilizes ITM 54 to transfer toner to the media, toner may be applied directly to the media by the one or more PC drums 122 as is known in the art.

While the example image forming device 20 shown in FIG. 1 utilizes a single component development system, in another embodiment, image forming device 20 utilizes what is commonly referred to as a dual component development system. In this embodiment, reservoir 112 of developer unit 110 stores a mixture of toner and magnetic carrier beads. The carrier beads may be coated with a polymeric film to provide triboelectric properties to attract toner to the carrier beads as the toner and the carrier beads are mixed in reservoir 112. Each developer unit 110 also includes a magnetic roll that attracts the carrier beads in reservoir 112 having toner thereon to the magnetic roll through the use of magnetic fields and transports the toner to the corresponding PC drum 122. Electrostatic forces from the latent image on PC drum 122 strip the toner from the carrier beads to form a toner image on the surface of PC drum 122. PC drum 122 is charged by charge roll 124 and cleaned by cleaner roll 126 as discussed above.

Figure 2:
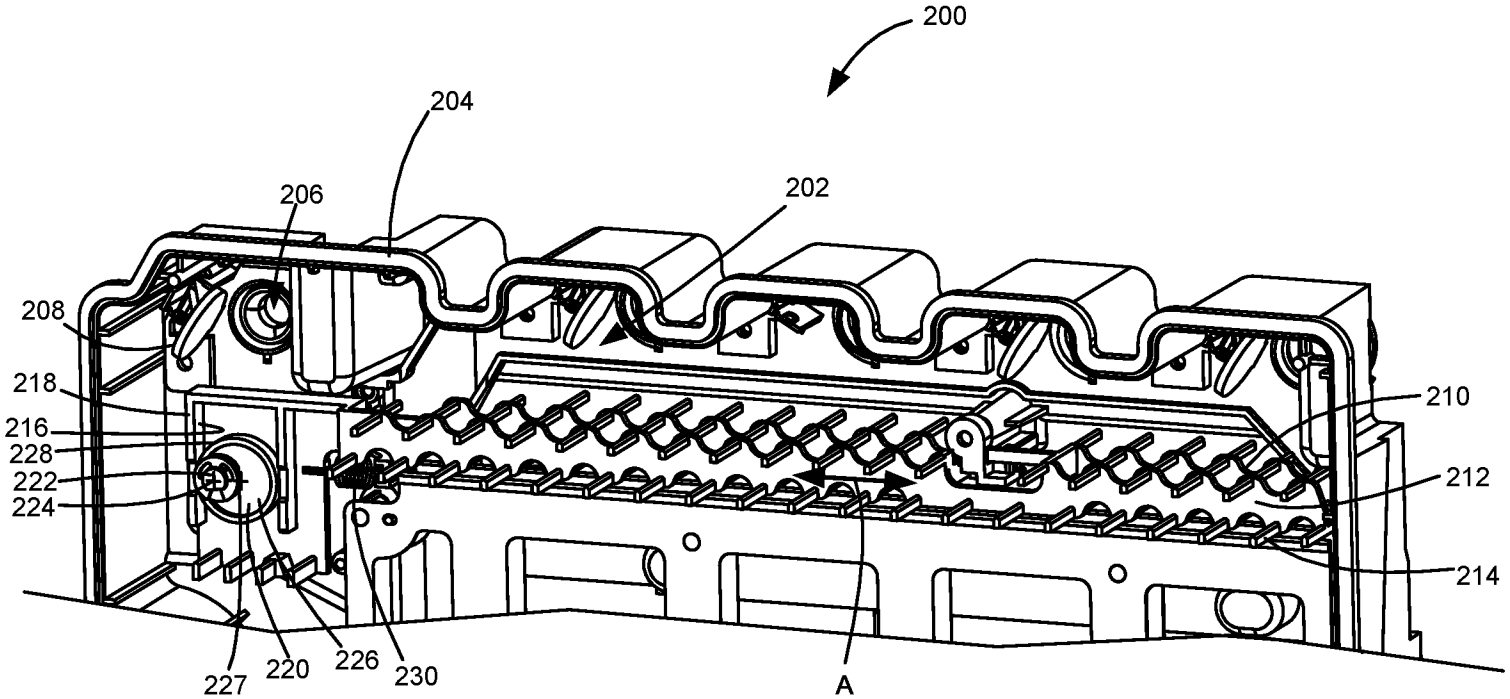
FIG. 2 is a perspective view of an interior of a waste toner container showing a toner agitator according to one example embodiment.

FIG. 2 illustrates a reservoir 202 of a waste toner container 200 of image forming device 20 according to one example embodiment. Reservoir 202 is contained within a housing 204 of waste toner container 200. Reservoir 202 stores waste toner that fails to transfer from and is then cleaned from PC drum(s) 122 or ITM 54 by cleaner rolls 126 or 128. Waste toner container 200 may be removable from image forming device 20 as desired in order to permit replacement or emptying of waste toner container 200 when it fills with toner in order to accommodate additional waste toner. As shown in FIG. 2, housing 204 includes one or more toner inlets 206 through which waste toner enters reservoir 202. Toner cleaned from PC drum(s) 122 and ITM 54 is fed to inlets 206 by toner conveyors, e.g., augers, paddles or the like. In the embodiment illustrated, each inlet 206 includes a shutter 208 that is movable between an open position that permits toner to enter reservoir 202 through inlets 206 and a closed position that prevents toner from leaking out of housing 204 when waste toner container 200 is removed from image forming device 20.

A toner agitator 210 is positioned within reservoir 202 to mix and break up any clumped toner in reservoir 202 in order to more evenly distribute the toner in reservoir 202 so that volumetric capacity of reservoir 202 is used more efficiently. Agitator 210 is movable in a reciprocating back and forth manner along a lengthwise direction thereof indicated by arrow A in FIG. 2. For example, in the embodiment illustrated, agitator 210 is translatable linearly in a reciprocating manner left and right as viewed in FIG. 2. In the example embodiment illustrated, agitator 210 includes a series of rake teeth 214 that extend outward from a spine 212 of agitator 210. Spine 212 extends along a lengthwise direction of agitator 210 and, in the embodiment illustrated, rake teeth 214 extend perpendicular to the lengthwise direction of agitator 210. However, rake teeth 214 may extend at any suitable angle or direction to the lengthwise direction of agitator 210. Further, agitator 210 may take many suitable forms other than the embodiment illustrated. For example, agitator 210 may include any desired form of paddle, scraper, conveyor, coil, etc.

Agitator 210 is driven by a rotatable cam 220. Cam 220 is rotated (e.g., counterclockwise as viewed in FIG. 2) by a drive shaft 222 that defines a rotational axis 224 of cam 220. Cam 220 includes an eccentric or irregular disc 226 or other shape that defines a cam surface 228 of cam 220. For example, in the embodiment illustrated, cam 220 includes a circular disc 226 that has a center 227 that is offset from rotational axis 224 of drive shaft 222. Agitator 210 includes an engagement surface 216 that is positioned to contact cam surface 228 and serve as a cam follower as cam 220 rotates. In the embodiment illustrated, engagement surface 216 is formed integrally with agitator 210 on a wall 218 that protrudes outward from spine 212 of toner agitator 210. In other embodiments, engagement surface 216 may be formed on a separate component connected to toner agitator 210.

A biasing member 230 biases engagement surface 216 of agitator 210 into contact with cam surface 228 such that engagement surface 216 remains in contact with cam surface 228 through the entire rotational path of disc 226. In the embodiment illustrated, biasing member 230 includes an extension spring that pulls engagement surface 216 of agitator 210 into contact with cam surface 228; however, any suitable biasing member may be used (e.g., a compression spring that pushes engagement surface 216 of agitator 210 into contact with cam surface 228, a leaf spring, a torsion spring or another member composed of a material having resilient properties).

Figure 3A:
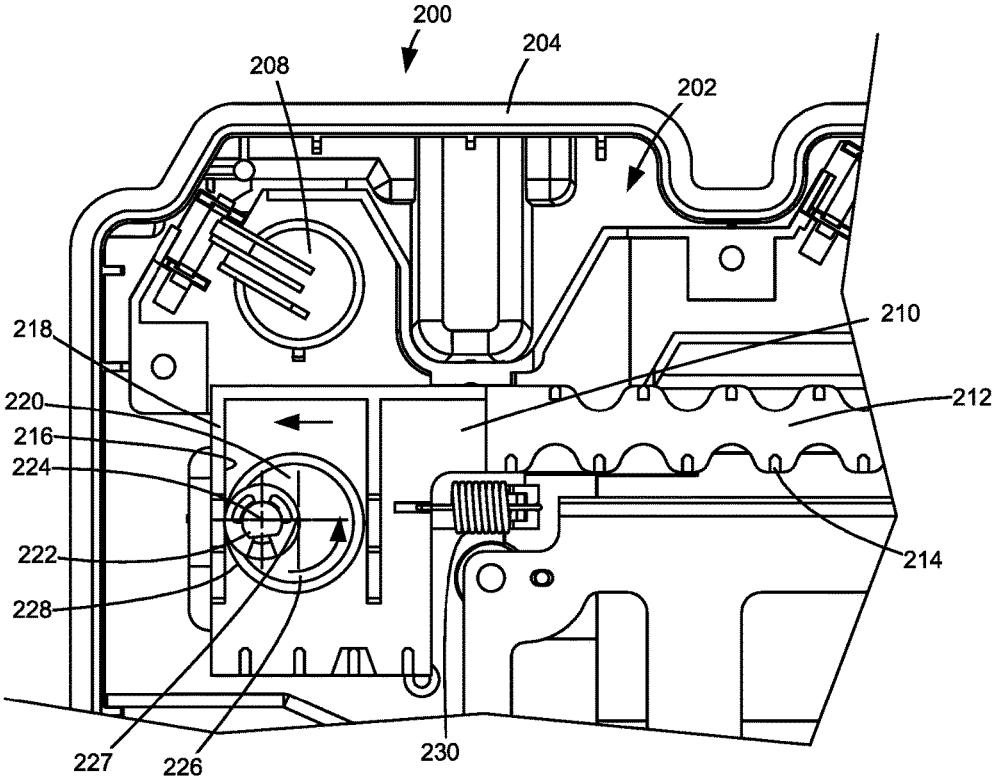
FIGS. 3A-3D are sequential elevation views of a cam drive of the toner agitator according to one example embodiment.
Figure 3B:
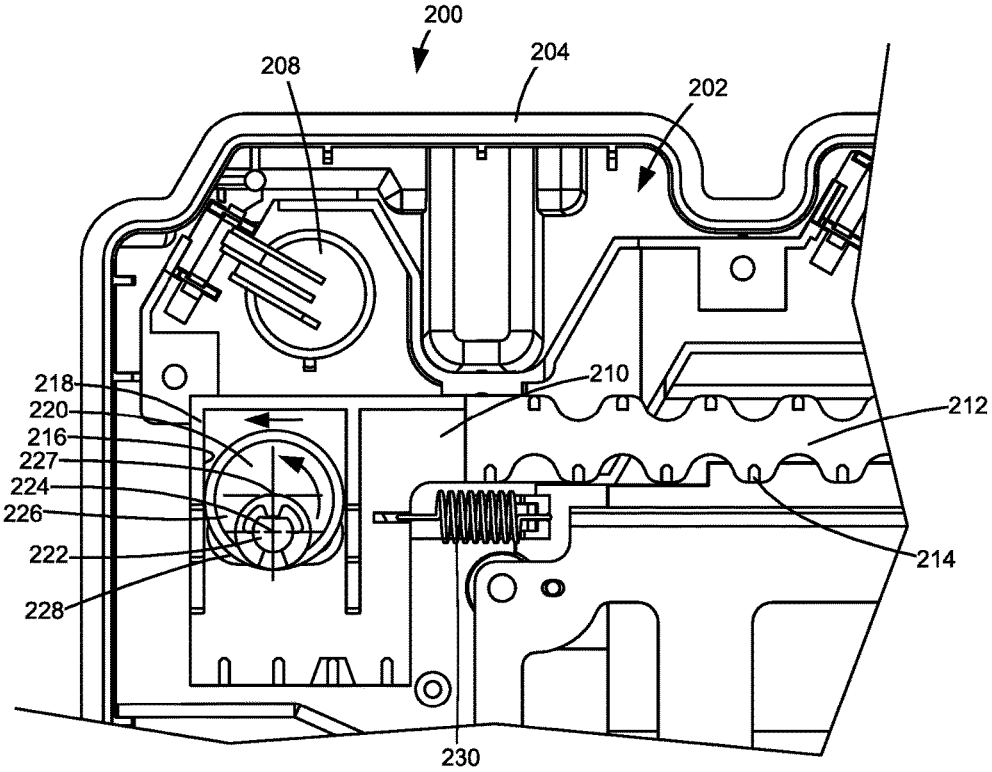
Figure 3C:
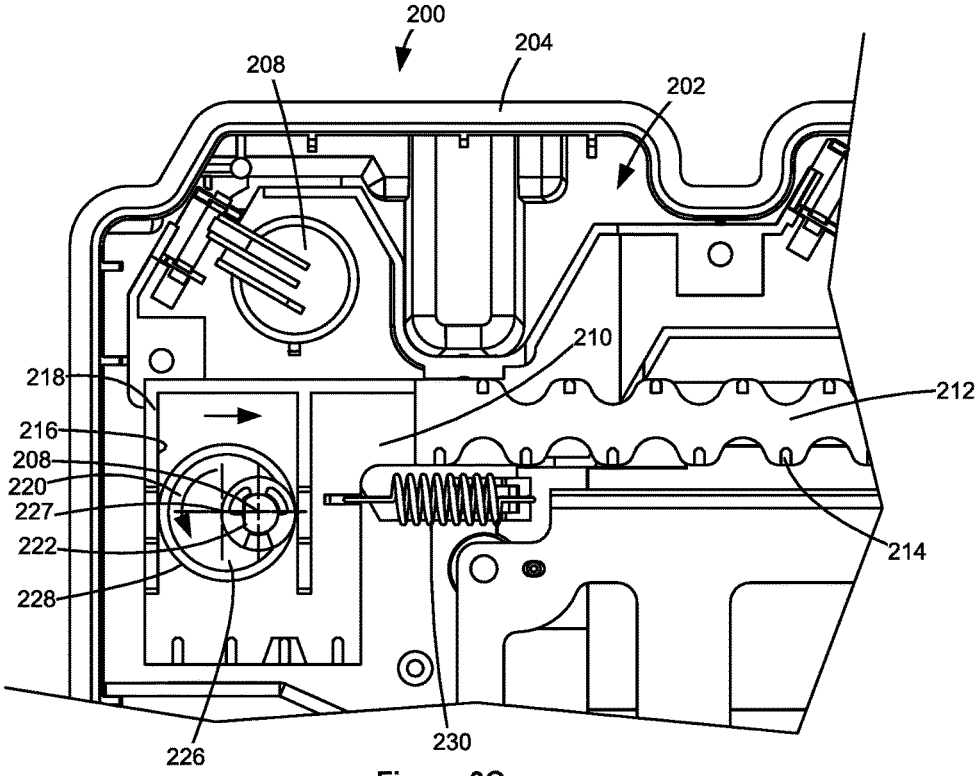
Figure 3D:
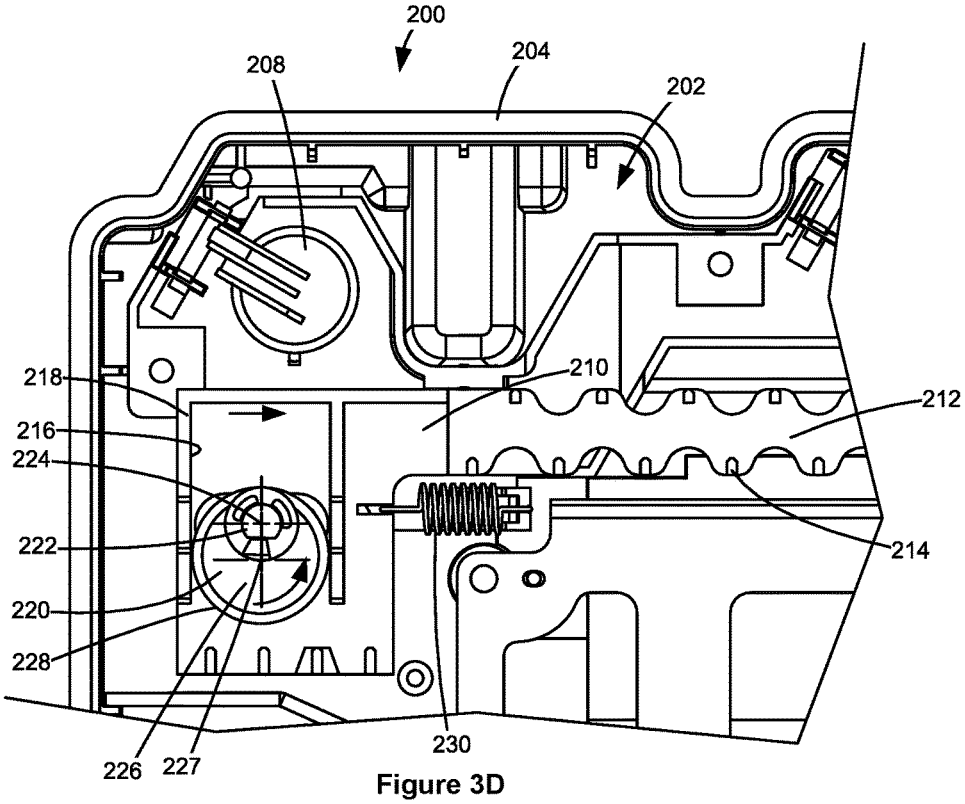

FIGS. 3A-3D illustrate sequential views of the motion of cam 220 and agitator 210 as drive shaft 222 rotates. As drive shaft 222 rotates counterclockwise as viewed in FIGS. 3A-3D, cam 220 rotates counterclockwise therewith. As cam 220 rotates counterclockwise from the position shown in FIG. 3A, through the position shown in FIG. 3B and toward the position shown in FIG. 3C, contact between cam surface 228 and engagement surface 216 of agitator 210 causes agitator 210 to move to the left as viewed in FIGS. 3A-3D against the bias applied to agitator 210 by biasing member 230 as center 227 of disc 226 moves to the left as shown in FIGS. 3A and 3B. FIG. 3C illustrates agitator 210 at one end of its travel (a leftmost end of travel as viewed in FIGS. 3A-3D). As cam 220 continues to rotate counterclockwise from the position shown in FIG. 3C, through the position shown in FIG. 3D and back toward the position shown in FIG. 3A, the bias applied to agitator 210 causes agitator 210 to move to the right as viewed in FIGS. 3A-3D in the direction of bias applied to agitator 210 by biasing member 230 with engagement surface 216 of agitator 210 remaining in contact with cam surface 228 as center 227 of disc 226 moves back to the right as shown in FIGS. 3C and 3D. FIG. 3A illustrates agitator 210 at the other end of its travel (a rightmost end of travel as viewed in FIGS. 3A-3D).

In the embodiment illustrated, engagement surface 216 of agitator 210 and cam surface 228 remain in constant contact through the entire rotational path of drive shaft 222 and cam 220. The constant contact between engagement surface 216 of agitator 210 and cam surface 228 reduces the noise generated by agitator 210 as agitator 210 moves back and forth within reservoir 202. Specifically, by maintaining contact between engagement surface 216 of agitator 210 and cam surface 228, noise that would otherwise be generated by the repeated engagement and disengagement of agitator 210 and its drive member is avoided. Further, in the embodiment illustrated, the constant contact between engagement surface 216 of agitator 210 and cam surface 228 allows agitator 210 to reciprocate freely back and forth without the use of motion limiting stops thereby avoiding the noise that would otherwise be generated by agitator 210 contacting a stop at the end of its travel in each direction.

Figure 4:
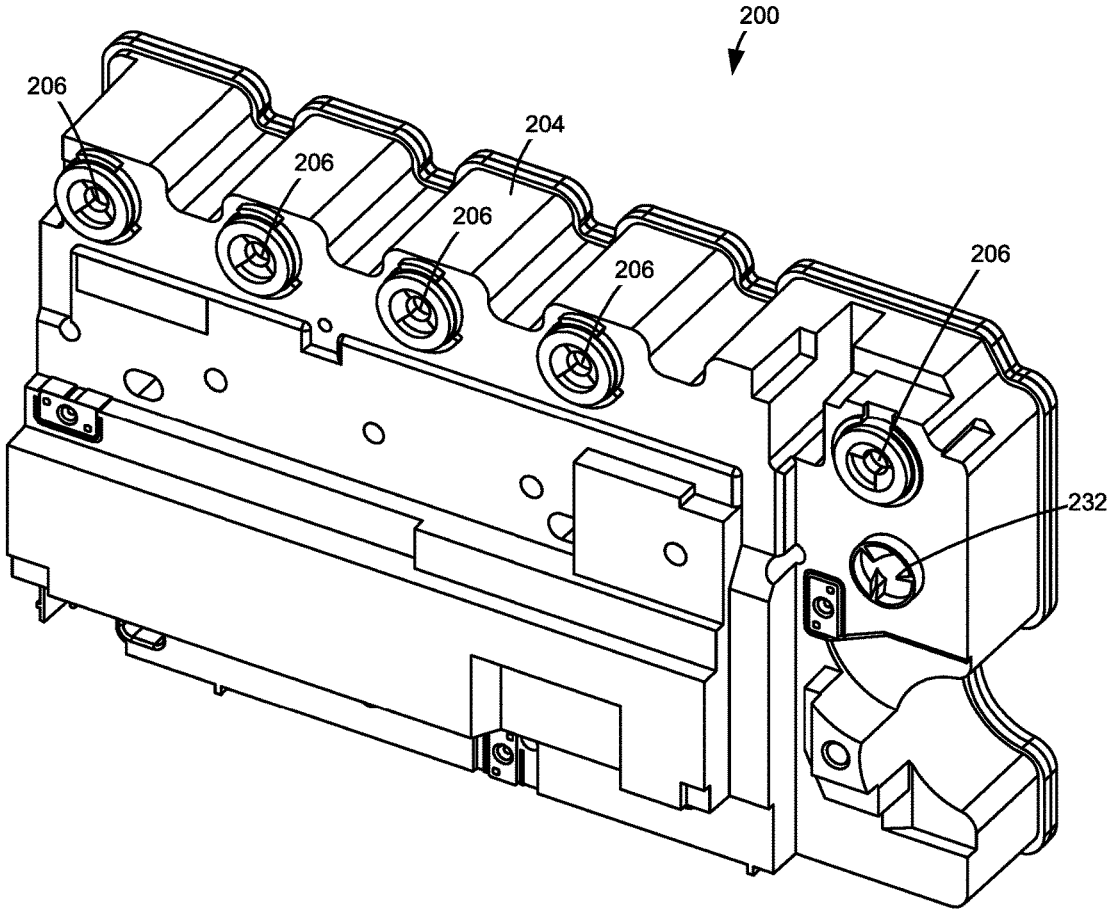
FIG. 4 is a perspective view of an exterior of the waster toner container showing a drive coupler that receives rotational motion to drive the toner agitator according to one example embodiment.

FIG. 4 illustrates the exterior of housing 204 of waste toner container 200 according to one example embodiment. Housing 204 includes a drive coupler 232 exposed on the exterior thereof and operatively connected (directly or indirectly) to drive shaft 222. When waste toner container 200 is installed in image forming device 20, drive coupler 232 mates with a corresponding drive member that provides rotational motion to drive coupler 232 from a motor in image forming device 20. Drive coupler 232 may be any suitable gear or coupling for receiving rotational motion.

While the example embodiment illustrated includes a cam driven agitator positioned in the reservoir of a waste toner container, it will be appreciated that such a cam arrangement may be used to drive a reciprocating agitator in any toner reservoir, such as, for example, reservoir 102 of toner cartridge 100 or reservoir 112 of developer unit 110.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner agitation system, comprising:

a toner agitator movable in a reciprocating manner;

a cam follower operatively connected to the toner agitator;

a rotatable cam having a cam surface that contacts the cam follower; and a biasing member that biases the cam follower into contact with the cam surface, wherein contact between the cam surface and the cam follower during rotation of the cam causes the toner agitator to move in the reciprocating manner, wherein the cam follower is formed integrally with the toner agitator.

2. The toner agitation system of claim 1, wherein the biasing member biases the cam follower into constant contact with the cam surface throughout an entire rotational path of the cam.

3. The toner agitation system of claim 1, wherein the biasing member is an extension spring that pulls the cam follower into contact with the cam surface.

4. The toner agitation system of claim 1, wherein the toner agitator is movable in the reciprocating manner along a lengthwise direction of the toner agitator.

5. The toner agitation system of claim 1, wherein the toner agitator is translatable linearly in the reciprocating manner.

6. The toner agitation system of claim 1, wherein the toner agitator is translatable linearly in the reciprocating manner along a lengthwise direction of the toner agitator.

7. A toner container, comprising:

a housing having a reservoir for storing toner;

a toner agitator movable in a reciprocating manner within the reservoir;

a cam follower operatively connected to the toner agitator;

a rotatable cam having a cam surface that contacts the cam follower; and a biasing member that biases the cam follower into contact with the cam surface, wherein contact between the cam surface and the cam follower during rotation of the cam causes the toner agitator to move in the reciprocating manner, wherein the cam follower is formed integrally with the toner agitator.

8. The toner container of claim 7, wherein the biasing member biases the cam follower into constant contact with the cam surface throughout an entire rotational path of the cam.

9. The toner container of claim 7, wherein the biasing member is an extension spring that pulls the cam follower into contact with the cam surface.

10. The toner container of claim 7, wherein the toner agitator is movable in the reciprocating manner along a lengthwise direction of the toner agitator.

11. The toner container of claim 7, wherein the toner agitator is translatable linearly in the reciprocating manner.

12. The toner container of claim 7, wherein the toner agitator is translatable linearly in the reciprocating manner along a lengthwise direction of the toner agitator.

13. A container for storing waste toner in an electrophotographic image forming device, comprising:

a housing having a reservoir for storing toner, at least one toner inlet permitting toner to enter the reservoir;

a toner agitator movable in a reciprocating manner within the reservoir, the toner agitator includes a cam follower;

a rotatable cam having a cam surface that contacts the cam follower; and a biasing member that biases the cam follower into constant contact with the cam surface throughout an entire rotational path of the cam, wherein contact between the cam surface and the cam follower during rotation of the cam causes the toner agitator to move back and forth in the reciprocating manner against a direction of bias of the biasing member on the cam follower and in the direction of bias of the biasing member on the cam follower, wherein the cam follower is formed integrally with the toner agitator.

14. The container for storing waste toner of claim 13, wherein the biasing member is an extension spring that pulls the cam follower into contact with the cam surface.

15. The container for storing waste toner of claim 13, wherein the toner agitator is movable in the reciprocating manner along a lengthwise direction of the toner agitator.

16. The container for storing waste toner of claim 13, wherein the toner agitator is translatable linearly in the reciprocating manner.

17. The container for storing waste toner of claim 13, wherein the toner agitator is translatable linearly in the reciprocating manner along a lengthwise direction of the toner agitator.

18. A toner container, comprising:

a housing having a reservoir for storing toner;

a toner agitator movable in a reciprocating manner within the reservoir;

a cam follower operatively connected to the toner agitator;

a rotatable cam having a cam surface that contacts the cam follower; and a biasing member that biases the cam follower into contact with the cam surface, wherein contact between the cam surface and the cam follower during rotation of the cam causes the toner agitator to move in the reciprocating manner, wherein the biasing member is an extension spring that pulls the cam follower into contact with the cam surface.

* * * * *